US007735952B2

(12) United States Patent
Bernard et al.

(10) Patent No.: US 7,735,952 B2
(45) Date of Patent: Jun. 15, 2010

(54) METHOD OF BONDING A MICRO-FLUID EJECTION HEAD TO A SUPPORT SUBSTRATE

(75) Inventors: David L. Bernard, Lexington, KY (US); Paul W. Dryer, Lexington, KY (US); Andrew L. McNees, Lexington, KY (US)

(73) Assignee: Lexmark International, Inc., Lexington, KY (US)

( * ) Notice: Subject to any disclaimer, the term of this patent is extended or adjusted under 35 U.S.C. 154(b) by 544 days.

(21) Appl. No.: 11/734,283

(22) Filed: Apr. 12, 2007

(65) Prior Publication Data

US 2008/0252692 A1 Oct. 16, 2008

(51) Int. Cl.
*B41J 2/015* (2006.01)
*B41J 2/04* (2006.01)

(52) U.S. Cl. ..... 347/20; 347/54

(58) Field of Classification Search ..... 347/54, 347/56, 20; 216/27

See application file for complete search history.

(56) References Cited

U.S. PATENT DOCUMENTS

| | | | | |
|---|---|---|---|---|
| 4,178,403 | A | 12/1979 | Sakurai et al. | |
| 4,670,967 | A | 6/1987 | Hazuki | |
| 6,787,051 | B2 | 9/2004 | Silverbrook | |
| 7,287,831 | B2 * | 10/2007 | Silverbrook | 347/49 |

OTHER PUBLICATIONS

Plobl, Andreas, et al. , "Wafer Direct Bonding: Tailoring Adhesion Between Brittle Materials," Materials Science and Engineering, 1-88, (1999) [Retrieved on Jul. 28, 2008]. <URL: http://www.mpi-halle.de/mpi/publi/pdf/782_99.pdf> entire document especially Fig 23, Fig 29, p. 28, para 1, p. 30, para 1 p. 49, para 2.

* cited by examiner

*Primary Examiner*—An H Do

(57) ABSTRACT

A substantially planar micro-fluid ejection device, where the micro-fluid ejection head is covalently bound to a substantially planar support material, and a method of making the same.

20 Claims, 2 Drawing Sheets

METHOD OF BONDING A MICRO-FLUID EJECTION HEAD TO A SUPPORT SUBSTRATE

TECHNICAL FIELD

The disclosure relates to a substantially planar micro-fluid head and, in a particular exemplary embodiment, to a substantially planar micro-fluid ejection head covalently bound to a substantially planar support material.

BACKGROUND

Micro-fluid ejection devices such as ink jet printers continue to experience wide acceptance as economical replacements for laser printers. Micro-fluid ejection devices also are finding wide application in other fields such as in the medical, chemical, and mechanical fields. As the capabilities of micro-fluid ejection devices are increased to provide higher ejection rates, the ejection heads, which are the primary components of micro-fluid ejection devices, continue to evolve and become larger, more complex, and more costly to manufacture.

One significant obstacle to be overcome in micro-fluid ejection head manufacturing process is maintaining the planarity of the ejection device substrate, also referred to as the ejection chip, and the nozzle plate during and after the manufacturing process, particularly when manufacturing ejection heads having an ejection swath dimension of greater than about 2.5 centimeters. The planarity of the ejection chip and the nozzle plate determine the direction in which a fluid such as ink is dispensed. If the nozzle plate is warped or bowed, due to warping or bowing of the underlying ejection device substrate, the desired direction of fluid-jetting is compromised. The planarity of these components may be affected by mismatched coefficients of thermal expansion between the various members of the ejection head, including the nozzle plate, the device substrate, the base support, and any adhesive material used in securing the aforementioned components to one another.

Current manufacturing processes utilize an adhesive die-bonding material to secure the components of the ejection head to one another. However, such adhesives require thermal curing which causes expansion and contraction of the components and may lead to warping or bowing of the ejection device substrate and the nozzle plate. Alterations in the thickness of the adhesive layer or the thickness of the underlying support material have led to only marginal improvements in the planarity of the finished devices. However, current manufacturing processes are limited by the size of the ejection chip. As the demand for larger ejection chips having larger ejection swaths grows, new device construction methods may be required to meet high tolerance manufacturing criteria for such ejection heads.

Accordingly, there is a need for improved structures and methods for making substantially planar micro-fluid ejection heads, suitable for ejection chips having an ejection swath dimension of greater than about 2.5 centimeters.

SUMMARY

With regard to the above and other objects, the present disclosure is directed to a micro-fluid ejection head having a substantially planar device substrate with a first surface and a second surface opposite the first surface. At least one fluid flow slot is formed therein from the first surface to the second surface. At least one micro-fluid ejection actuator is adjacent to the second surface. The first surface of the device substrate is covalently bound to a substantially planar support having at least one fluid flow slot formed therein. The slot in the support is associated with the fluid flow slot in the device substrate.

In another aspect of the present disclosure, a micro-fluid ejection head is provided having a substantially planar device substrate with a first surface and a second surface opposite the first surface. At least one fluid flow slot is formed therein from the first surface to the second surface. At least one micro-fluid ejection actuator is adjacent to the second surface. The first surface of the device substrate is bound without the use of an adhesive material to a substantially planar support material having at least one fluid flow slot formed therein. The slot in the support material is associated with the fluid flow slot in the device substrate.

In a further embodiment of the present disclosure, a process for making a substantially planar micro-fluid ejection head is provided. The process includes depositing a thin film of silicon oxide onto a surface of a substantially planar support material having at least one fluid flow slot formed therein. The film of silicon oxide is then activated. A first surface of a substantially planar device substrate is also activated. The device substrate has at least one fluid flow slot therein and at least one micro-fluid ejection actuator adjacent to a second surface thereof. The activated surfaces are coated with a reactive functional group and subsequently contacted with one another thereby covalently bonding the support material and the device substrate to one another.

An advantage of the structures and method of the present disclosure is that the covalent bond is formed at room temperature, eliminating heat curing steps of the presently used die-bonding adhesive methods that result in bowing or warping of the device substrate and nozzle plate due to mismatched coefficients of thermal expansion ("CTE") between the different materials. Another advantage of the present disclosure is that the covalent bond between the device substrate and the support material provides a hermetic seal that is not susceptible to attack or degradation by fluids such as ink, unlike adhesive die-bonding materials.

BRIEF DESCRIPTION OF THE DRAWINGS

Further advantages of the exemplary embodiments may become apparent by reference to the detailed description of the exemplary embodiments when considered in conjunction with the following drawings illustrating one or more non-limiting aspects of thereof, wherein like reference characters designate like or similar elements throughout the several drawings as follows.

DESCRIPTION OF THE EXEMPLARY EMBODIMENTS

Figure 1:
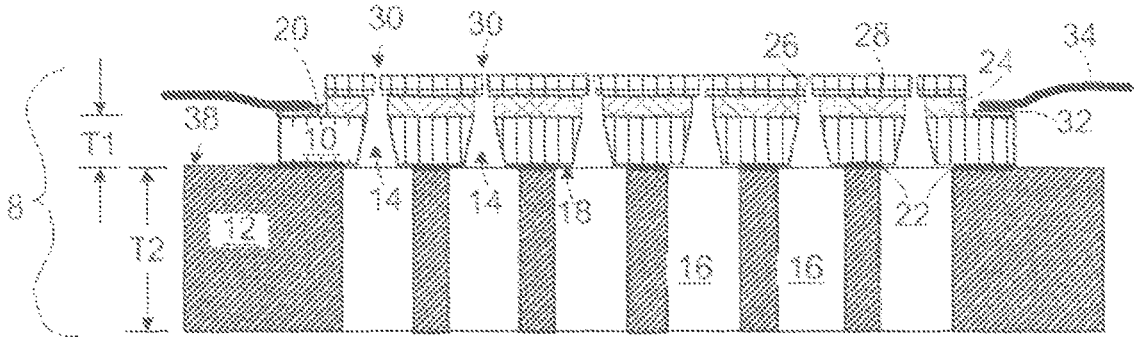
FIG. 1 is a cross-sectional view, not to scale, of a micro-fluid ejection head structure according to an embodiment of the present disclosure.

With reference to FIG. 1, the present disclosure is directed to a substantially planar micro-fluid ejection head 8 comprising a substantially planar device substrate 10 and a substantially planar support material 12. The device substrate 10 has at least one fluid flow slot 14 formed therein. The support material 12 has at least one fluid flow slot 16 formed therein that corresponds to the slot 14 on the device substrate 10. The device substrate 10 additionally has a first surface 18 and a second surface 20 opposite the first surface. The first surface 18 of the device substrate 10 is secured to the support material 12 by covalent bonding at a point of contact 22 between the device substrate 10 and the support material 12.

The device substrate 10 may further comprise a layer of flow feature material 24 attached adjacent to the second surface 20 of the device substrate 10. The flow feature material 24 has at least one fluid flow channel and chamber 26 formed therein that corresponds to the slot 14 in the device substrate 10. A nozzle plate 28 having at least one fluid ejection aperture 30 corresponding to the channel and chamber 26 in the flow feature material 24 is attached adjacent to the flow feature material 24. The device substrate 10 additionally may have a bond pad electrical connection 32 for connecting an electrical lead tab 34 of a flexible circuit to the device substrate 10.

The device substrate 10 may be a portion of a preformed silicon semiconductor wafer, or functionally similar material, having a first surface 18 and a second surface 20 and at least one fluid flow slot 14 formed therein, as described above. At least one micro-fluid ejection actuator (not shown here) may be adjacent to the second surface 20 in association with the slot 14 and in electrical communication with a driver circuit (not shown) also adjacent to the second surface 20. The device substrate 10 may have a thickness T1 ranging from about 10 to about 800 microns.

The flow feature material 24 may be a substantially planar patterned layer of photoresist or any similar material wherein at least one fluid flow channel and chamber 26 has been formed therein by the removal of at least a portion of the flow feature material 24.

The nozzle plate 28 may be a photoresist nozzle plate, a polyimide nozzle plate, a metal nozzle plate, or other substantially planar patternable or micro-machinable material suitable for the purpose of providing fluid ejection apertures 30 therein. In the case of a patternable flow feature layer 24, the nozzle plate 28 may be laminated to, spun on, or adhesively attached to the flow feature layer 24.

The support material 12 may be a substantially planar preformed portion of a glass, ceramic, or silicon wafer, or another material having a CTE similar to the CTE of the device substrate 10. The support material 12 may have at least one fluid flow slot 16 formed therein, corresponding to the slot 14 on the device substrate 10. The slot 16 permits fluid flow from a fluid reservoir (not shown) to the slot 14 of the device substrate 10. The support material may have a thickness T2 ranging from about 1 mm to about 5 mm. Multiple thin layers of material may also be used to provide the support material 12. The multiple thin layers may include one or more materials that have been covalently bound to one another by the method described below, to provide a single support material 12.

In the present disclosure, the device substrate 10 may be covalently bound at one or more points of contact 22 to the support material 12. The nozzle plate aperture 30, flow feature channel and chamber 26, device substrate slot 14, and support material slot 16 are aligned so that fluid may flow continuously from a fluid reservoir (not shown) to the actuators on the second surface 20 of the device substrate 10 for ejection through the nozzle apertures 30. Alignment fiducials may optionally be present on the support material 12 for the purpose of ensuring proper alignment of the support material 12 to the device substrate 10. In another embodiment of the present disclosure, infrared cameras may be used by an automated system in order to ensure proper alignment of the components. Such methods of aligning different layers are well known to those skilled in the art.

Figure 2:
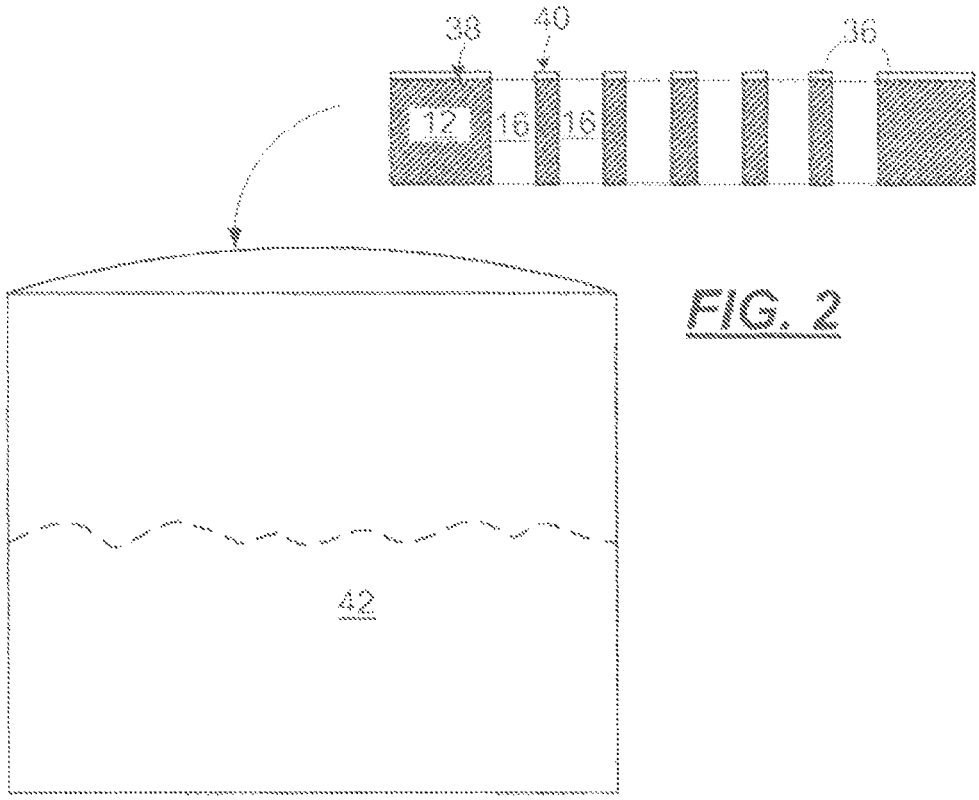
FIG. 2 is a diagrammatic illustration of a process for activating a support material according to an embodiment of the disclosure.

With reference to FIG. 2, and referring back to FIG. 1, a further embodiment of the present disclosure is directed to a process for making a substantially planar micro-fluid ejection head 8. The process includes activating a surface 40 of a bonding layer 36 on a surface 38 of the substantially planar support material 12 and activating the first surface 18 of the device substrate 10. The activated surfaces 18 and 40 are then contacted with one another at room temperature, at which point covalent bonds spontaneously from between the two contacted surfaces 18 and 40 and form a hermetic seal.

In the case of a non-silicon support material 12, the bonding layer 36 may be deposited on the surface 38 of the support material 12. In the case of a silicon support material 12, the bonding layer 36 may be formed by oxidation of the surface 38 of the silicon support material 12. The bonding layer 36 may be any solid state material or mixed materials which may be deposited or formed at relatively low temperatures and may subsequentially be polished to provide a substantially smooth surface. The bonding layer 36 may be an insulator, such as silicon oxide, or amorphous silicon, formed using chemical vapor deposition ("CVD") or plasma-enhanced CVD ("PECVD"), sputtering, or evaporation. Other materials such as polymers, semiconductors or sintered materials may also be used. A suitable bonding layer 36 should have a thickness greater than a surface topography of the support material 12 in order to provides a sufficiently planarized surface 40. For example, the bonding layer 36 may have a thickness ranging from about 50 Angstroms to about 15 microns or more.

The surface 40 of the bonding layer 36 may then be activated for bonding. This step may be accomplished using chemical-mechanical polishing ("CMP"). The surface 40 is preferably polished to a roughness of about no more than about 3 nm and preferably no more than about 2.5 nm and is substantially planar. The surface roughness values are typically given as root-mean square ("RMS") values. Also, the surface roughness may be given as mean values which are nearly the same as the RMS values.

After the CMP step, the surface 40 may be cleaned and dried to remove any residue from the polishing step. Residue retained on the surface 40 from the polishing step may interfere with the subsequent bonding between the surface 40 and the first surface 18 of the device substrate, so in some embodiments the surface 40 is cleaned after the CMP step prior to the bonding step.

The same activation procedure, as described above, may be carried out on the device substrate 10 in order to activate the first surface 18 as a bonding surface, with the exception that no bonding layer deposition step is required if the device substrate 10 already has a suitable silicon oxide layer adjacent the first surface 18 thereof. If the device substrate 10 comprises a silicon semiconductor device, such a layer of silicon oxide may typically be formed on the silicon during the semiconductor manufacturing process, so that no additional silicon oxide deposition may be needed.

In an exemplary embodiment of the present disclosure, the post-CMP process may include contacting the activate surfaces 18 and 40 with a solution containing a reactive chemical selected to generate surface reactions that result in coating, or terminating, the activated surfaces 18 and 40 with a desired reactive species. Contacting the surfaces 18 and 40 with the reactive solution may be accomplished as by spraying, roll coating, dipping, vapor deposition, or immersion of the surfaces 18 and 40 in the solution. In some embodiments, the contacting step occurs immediately after the CMP process. A suitable surface termination may include a monolayer or a few monolayers of atoms or molecules of the reactive species.

In an exemplary embodiments, the activated surfaces 18 and 40 are terminated with a reactive species by dipping the device substrate 10 and the support material 12 into a solution 42 of a reactive compound. The two activated, treated surfaces 18 and 40 are subsequently contacted with one another at room temperature, without the addition of heat to the substrates. Covalent bonds may spontaneously form between the two surfaces 18 and 40 at points of contact 22, forming a substantially hermetic seal between the two surfaces 18 and 40.

The reactive chemical solution used for the post-CMP process may be a solution of ammonium hydroxide, ammonium fluoride, or hydrogen fluoride. The concentration of such a solution may range from about 0.5 to about 40 wt. %. Accordingly the solution may contain from about 0.5 to about 5.0 wt. % ammonium hydroxide, from about 10 to about 40 wt. % ammonium fluoride 10 to 40 wt. %, and from about 0.05 to about 5.0 wt. % hydrofluoric acid.

In an exemplary embodiment of the present disclosure, the device substrate 10, flow feature material 24, and nozzle plate 28 are assembled as a single unit prior to the activation of the first surface of the device substrate 10 and initiation of bonding with the support material 12. In other embodiments, the device substrate 10 may first be bonded to the support material 12 prior to attaching the flow feature material 24 and the nozzle plate 28 to the device substrate 10. The flow feature material 24 and the nozzle plate 28 may be, in a further embodiment, integrated as a single component before being attached to the device substrate 10. Since the thickness T2 of the support material 12 is desirable greater than the thickness T1 of the device substrate 10, any bowing of the device substrate 10 before the device substrate 10 is bonded to the support material 12 may be eliminated once the device substrate 10 is bound to the support material 12.

Figure 3:
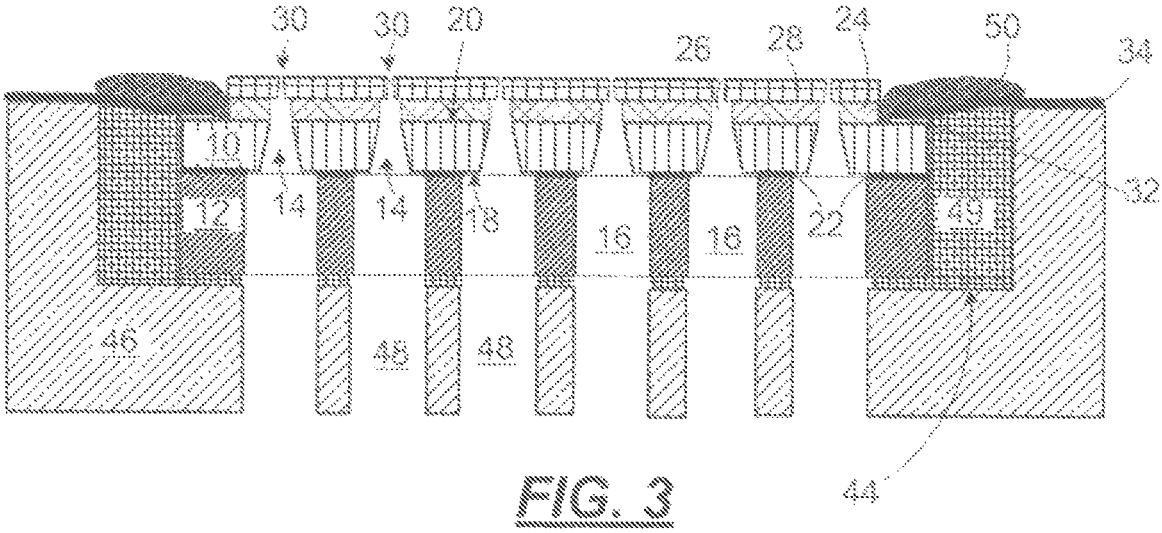
FIG. 3 is a cross-sectional view of a micro-fluid ejection head structure according to another embodiment of the present disclosure.

After the device substrate 10, including the nozzle plate 28 and the flow feature material 24, and the support material 12 have been bound to one another, the entire ejection head 8 may be inserted into and adhesively attached within a recessed cavity 44 of a plastic fluid reservoir or bottle 46, as illustrated in FIG. 3. The cavity 44 may have at least one slot 48 for fluid flow corresponding to the at least one slot 16 on the support material 12. Electrical leads 34 of a flexible circuit may be attached to the electrical connections 32 on the device substrate before the assembled fluid ejection head 8 is bonded or otherwise fixedly adhered to the bottle 46 using adhesive 49. In order to reduce or eliminate corrosion of the electrical leads 34 and connections 32, a protective encapsulant material 50 may be applied as a protective barrier over the electrical leads 34 and connections 32. The adhesive 49 may be sufficient to fill any gaps existing between the ejection head 8 and the bottle 46 in the cavity 44 as shown in FIG. 3.

As set forth above, it is desirable that the support material 12 that is covalently bonded to the device substrate 10 be comprised of a material that has a similar CTE to the device substrate 10. Both the thickness of the support material 12 and the CTE similarity may lead to a reduction of warping of the ejection head 8 during the subsequent curing or annealing of any adhesive 49 and/or encapsulant 50 materials used to assemble the ejection head 8 and bottle 46 to one another.

In a further embodiment of the present disclosure, the activation of the surface 18 of the device substrate 10 and the silicon oxide surface 40 of the bonding layer 36 of the support material 12 may be accomplished by etching or grinding the surfaces 18 and 40 so that they retain essentially the same planarity as before the etching or grinding, generally as described in U.S. Pat. No. 6,902,987 and U.S. Patent Publication No. 2005/0079712. Without desiring to be bound by theoretical considerations, it is believed that slight removal of a portion of the surfaces 18 and 40 breaks some of the bonds in the silicon oxide at the surfaces 18 and 40 and results in activation of the surfaces 18 and 40. The activated silicon oxide surfaces 18 and 40 may then readily engage in substitution reactions with the reactive solution during further processing, resulting in surfaces 18 and 40 being terminated with a bonding species, as previously described.

When the two surfaces 18 and 40 that have been activated and terminated with a bonding species are brought into contact with one another at room temperature, covalent bonds may spontaneously form between the activated surfaces 18 and 40. The two surfaces 18 and 40 are hermetically sealed together by the covalent bonds to provide a substantially unitary structure. Additional force or pressure may or may not be required to be applied to the device substrate 10 and the support material 12 during the contacting of the two surfaces 18 and 40 in order to allow them to achieve favorable proximity for covalent bond formation.

At numerous places throughout this specification, reference had been made to a number of U.S. patents and/or patent publications. The relevant portions of all such cited documents are expressly incorporated in full into this disclosure as if fully set forth herein.

The foregoing embodiments are susceptible to considerable variation in their practice. Accordingly, the embodiments are not intended to be limited to the specific exemplifications set forth hereinabove. Rather, the foregoing embodiments are within the spirit and scope of the appended claims, including the equivalents thereof available as a matter of law.

The patentees do not intend to dedicate any disclosed embodiments to the public, and to the extent any disclosed modifications or alterations may not literally fall within the scope of the claims, they are considered to be part hereof under the doctrine of equivalents.

What is claimed is:

1. A micro-fluid ejection head comprising:

a substantially planar device substrate having a first surface and a second surface opposite the first surface, at least one fluid flow slot formed therein from the first surface to the second surface, and at least one micro-fluid ejection device adjacent to the second surface; and a substantially planar support covalently bonded to the first surface of the device substrate, the support having at least one fluid flow slot formed therein that is associated with the slot in the device substrate.

2. The micro-fluid ejection head of claim 1, wherein the device substrate comprises a preformed micro-fluid ejection chip having at least one micro-fluid ejection device comprising at least one actuator in electrical communication with at least one driver circuit.

3. The micro-fluid ejection head of claim 1, wherein the support is selected from the group consisting of ceramic, glass, and silicon.

4. The micro-fluid ejection head of claim 1, wherein the support ranges in thickness from about 1 mm to about 5 mm.

5. The micro-fluid ejection head of claim 1 further comprising a flow feature material having at least one fluid flow channel formed therein, adjacent to the second surface of the device substrate.

6. The micro-fluid ejection head of claim 5 further comprising a nozzle plate having at least one fluid ejection aperture formed therein, fixedly attached adjacent to the flow feature material.

7. The micro-fluid ejection head of claim 1 further comprising a nozzle plate having at least one fluid ejection aperture and at least one fluid flow channel associated with the aperture formed therein, wherein the nozzle plate is fixedly attached adjacent to the second surface of the device substrate.

8. A micro-fluid ejection head comprising:

a substantially planar device substrate having a first surface and a second surface opposite to the first surface, and having at least one fluid flow slot formed therein from the first surface to the second surface, and at least one micro-fluid ejection device adjacent to the second surface; and a substantially planar support bonded to the first surface of the device substrate without an adhesive bonding material, the support having at least one fluid flow slot formed therein that is associated with the slot in the device substrate.

9. The micro-fluid ejection head of claim 8 further comprising a nozzle plate having at least one fluid ejection aperture and at least one fluid flow channel associated with the aperture formed therein, wherein the nozzle plate is fixedly attached adjacent to the second surface of the device substrate.

10. A process for making a substantially planar micro-fluid ejection head comprising:

depositing a thin film of silicon oxide on at least one surface of a substantially planar support having at least one fluid flow slot formed therein;

activating the film of silicon oxide;

activating a first surface of a substantially planar device substrate having at least one fluid flow channel slot therein and at least one micro-fluid ejection device formed adjacent to a second surface thereof;

coating the activated film on the support and the activated first surface of the device substrate with a reactive functional group; and contacting the coated, activated film on the support with the coated, activated first surface of the substrate thereby covalently bonding the support and the device substrate to one another.

11. The process of claim 10 wherein the film of silicon oxide is activated by chemical-mechanical polishing.

12. The process of claim 10 wherein the film of silicon oxide is activated by grinding.

13. The process of claim 10 wherein the film of silicon oxide is activated by etching.

14. The process of claim 10 wherein first surface of the device substrate is activated by chemical-mechanical polishing.

15. The process of claim 10 wherein the first surface of the device substrate is activated by etching.

16. The process of claim 10 wherein the step of coating comprises contacting the activated film of silicon oxide and the activated first surface of the device substrate with an aqueous solution selected from the group consisting of ammonium hydroxide, ammonium fluoride, and hydrogen fluoride.

17. The process of claim 10 further comprising attaching a flow feature material having at least one fluid flow channel formed therein to the second surface of the substrate.

18. The process of claim 17 further comprising attaching a nozzle plate having at least one fluid ejection aperture formed therein to the flow feature material.

19. The process of claim 10 further comprising attaching a nozzle plate having at least one fluid ejection aperture and at least one fluid flow channel formed therein associated with the aperture, to the second surface of the device substrate.

20. The process of claim 10 wherein the device substrate comprises:

a flow feature material having at least one fluid flow channel formed therein and attached to the second surface of the substrate; and a nozzle plate having at least one fluid ejection aperture formed therein attached to the flow feature material, wherein the nozzle plate and the flow feature material are formed from a single material or a plurality of materials.

* * * * *